US005292268A

United States Patent [19]

Walkup

[11] Patent Number: 5,292,268

[45] Date of Patent: Mar. 8, 1994

[54] CONTROLLED IMPEDANCE SHIELD FOR AN ELECTRICAL CONNECTOR

[75] Inventor: William B. Walkup, Huntington, Conn.

[73] Assignee: Burndy Corporation, Norwalk, Conn.

[21] Appl. No.: 926,100

[22] Filed: Aug. 5, 1992

[51] Int. Cl.[5] ..... H01R 13/648

[52] U.S. Cl. ..... 439/607; 439/65; 439/108

[58] Field of Search ..... 439/65, 59, 92, 95, 439/101, 108, 607-610

[56] References Cited

U.S. PATENT DOCUMENTS

| | | | |
|---|---|---|---|
| 3,329,925 | 7/1967 | Johnson et al. | 439/610 X |
| 3,474,377 | 10/1969 | Carlson et al. . | |
| 3,922,056 | 11/1975 | Murawski et al. | 439/607 |
| 4,571,014 | 2/1986 | Robin et al. | 439/608 X |
| 4,678,260 | 7/1987 | Gallusser et al. | 439/607 |
| 4,806,109 | 2/1989 | Manabe et al. | 439/108 |
| 4,812,137 | 3/1989 | Wilson et al. | 439/607 |
| 4,853,659 | 8/1989 | Kling | 333/184 |
| 4,959,024 | 9/1990 | Czeschka | 439/607 |
| 5,035,631 | 7/1991 | Piourunneck et al. | 439/108 |
| 5,059,140 | 10/1991 | Philippson et al. | 439/607 |
| 5,094,627 | 3/1992 | Uekido | 439/610 |
| 5,112,251 | 5/1992 | Cesar | 439/607 |

*Primary Examiner*—Larry I. Schwartz
*Assistant Examiner*—Khiem Nguyen
*Attorney, Agent, or Firm*—Perman & Green

[57] ABSTRACT

An electrical connector shield is provided that includes a metal shield member, a dielectric spacer, and a fastener for fastening the shield member to a first connector. The shield member has a first section adapted to be connected to the first connector and a second section offset from the first section and spaced from the first connector to thereby form a second connector receiving area. The shield member is suitably sized and shaped to shield at least one substantially entire side of both of the first and second connectors when connected to each other.

11 Claims, 2 Drawing Sheets

CONTROLLED IMPEDANCE SHIELD FOR AN ELECTRICAL CONNECTOR

BACKGROUND OF THE INVENTION

1. Field of the Invention

The present invention relates to electrical connectors and, more particularly, to an electrical connector with a controlled impedance shield.

2. Prior Art

There are various different types of shielded electrical connectors known in the prior art including those disclosed in U.S. Pat. Nos. 5,112,251; 5,094,627; 5,059,140; 5,035,631; 4,959,024; 4,853,659; 4,806,109; 4,678,260; and 3,474,377. However, as new high speed connectors are being developed, there has emerged a need for an improved shield for electrical connectors that can enhance system performance by controlling impedance with higher inductance ground return paths.

Therefore, it is an object of the present invention to provide a new and improved electrical connection system that has enhanced controlled impedance characteristics.

SUMMARY OF THE INVENTION

In accordance with one embodiment of the present invention, an electrical connector shield is provided comprising a first metal shield member, a dielectric spacer, and means for connecting the top section of the shield member to a first electrical connector. The first metal shield member has a top section and a bottom section. The top section has a substantially planar shape. The bottom section has a substantially planar shape offset from a plane of the top section. The dielectric spacer is attached to the top section of the shield member. The means for connecting can connect the top section of the shield to the first electrical connector with the spacer therebetween such that a second electrical connector receiving space is formed between the bottom section of the shield and a bottom of the first electrical connector to shield at least one substantially entire side of both electrical connectors when connected to each other.

In accordance with another embodiment of the present invention, an electrical connector is provided comprising a frame, signal conductors, and a metal shield. The frame has a substantially planar section forming a card edge connector area. The signal conductors are connected to the frame along the card edge connection area. The metal shield is connected to the frame and has a first section located proximate the card edge connection area, but electrically isolated from the signalled conductors, and a second section spaced from the frame and forming a second conductor receiving space between the space and the second section such that at least a portion of the card edge connector area can be positioned into the second connector with a portion of the second connector being received in the second connector receiving space.

In accordance with another embodiment of the present invention, an electrical connection system is provided comprising a first electrical connector, a second electrical connector, and a metal shield. The second electrical connector is adapted to receive a portion of the first electrical connector therein. The metal shield is fixedly connect to the first connector. The shield covers a substantial portion of the first connector and, is adapted to substantially surround substantially the entire second connector when the two connectors are connected to each other.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
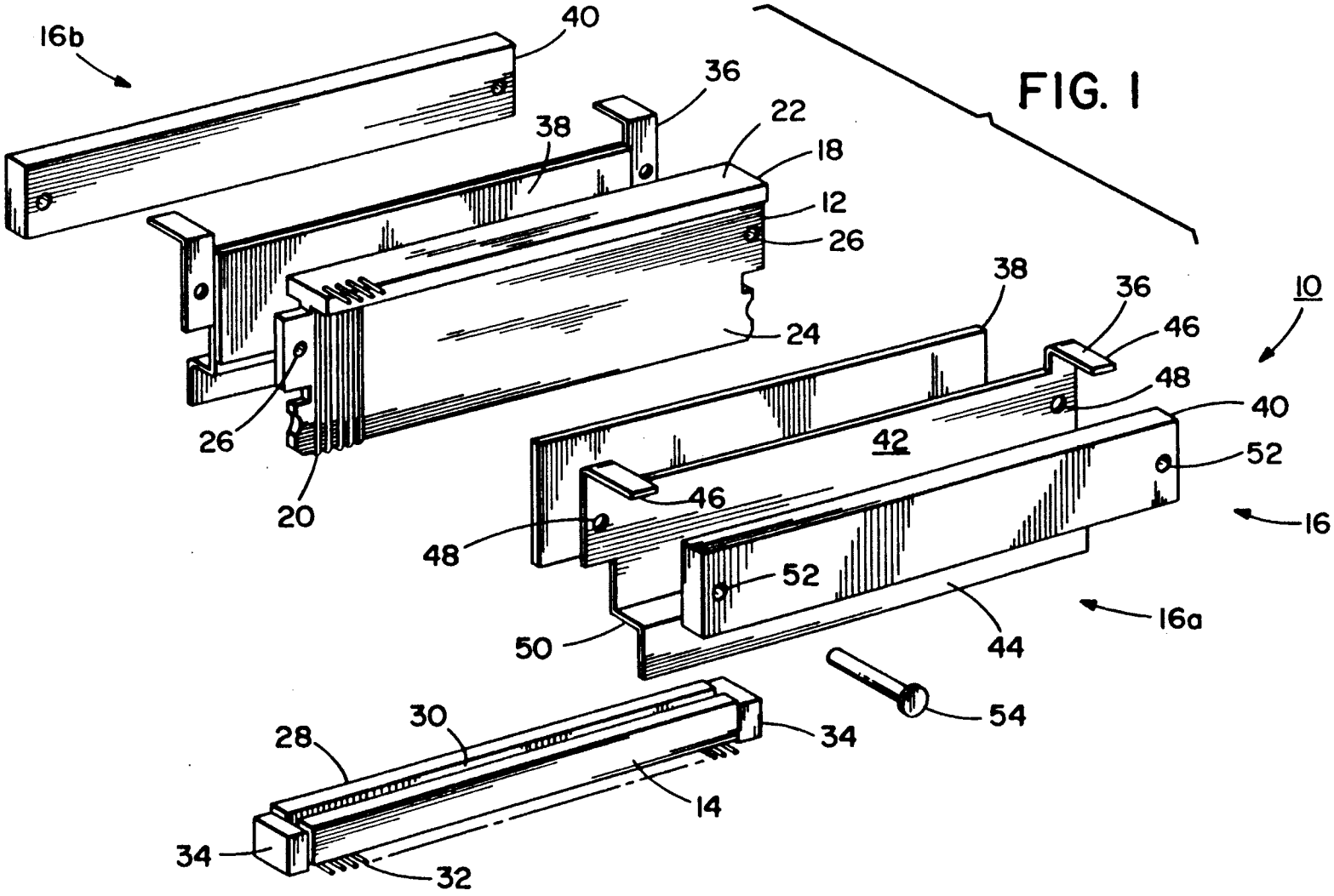
FIG. 1 is an exploded perspective view of a connection system incorporating features of the present invention.

Referring now to FIG. 1, there is shown an exploded perspective view of a connection system 10 incorporating features of the present invention. Although the present invention will be described with reference to the single embodiment shown in the drawings, it should be understood that the present invention can be used in any suitable type of connector system. In addition, it should also be understood that any suitable size, shape, or type of elements or materials can be provided without departing from the spirit of the invention.

The connection system 10 generally comprises a first electrical connector 12, a second electrical connector 14, and a shield 16. In the embodiment shown, the first electrical connector 12 generally comprises a frame 18 and a plurality of electrical conductors 20. The frame 18 is generally comprised of a dielectric material that has a top section 22 and a bottom section 24. The top section 22 is generally adapted to be connected to an electrical component such as a printed circuit board or a hard disk drive. However, the first connector 12 can be connected to any suitable type of electronic component. The bottom section 24 has a general planar shape and forms a card edge connector area with the conductors 20 being mounted or formed on the frame 18 therealong. As can be seen, tops of the conductors 20 are located at the top section of the frame 18 and extend down along the bottom section 24. In the embodiment shown, conductors 20 are provided on both sides of the frame 18. The frame 18 also includes two rivet holes 26.

The second electrical connector 14, in the embodiment shown, generally comprises a housing 28 having a receiving slot 30, a plurality of electrical spring contacts 32, and control buttons 34. The receiving slot 30 is generally adapted to receive a portion of the first connector 12 therein. The contacts 32 have portions located in the receiving slot 30 adapted to make electrical contact with the conductors 20 when the first connector 12 is inserted into the receiving slot 30. The control buttons 34 are generally adapted to move the electrical contacts 32 out of engagement, or substantially out of engagement, with the conductors 20 to thereby assist in reducing the amount of force necessary to disconnect the first connector 12 from the second connector 14. However, it should be understood that any suitable type of first connector 12 or second connector 14 can be provided.

Figure 2:
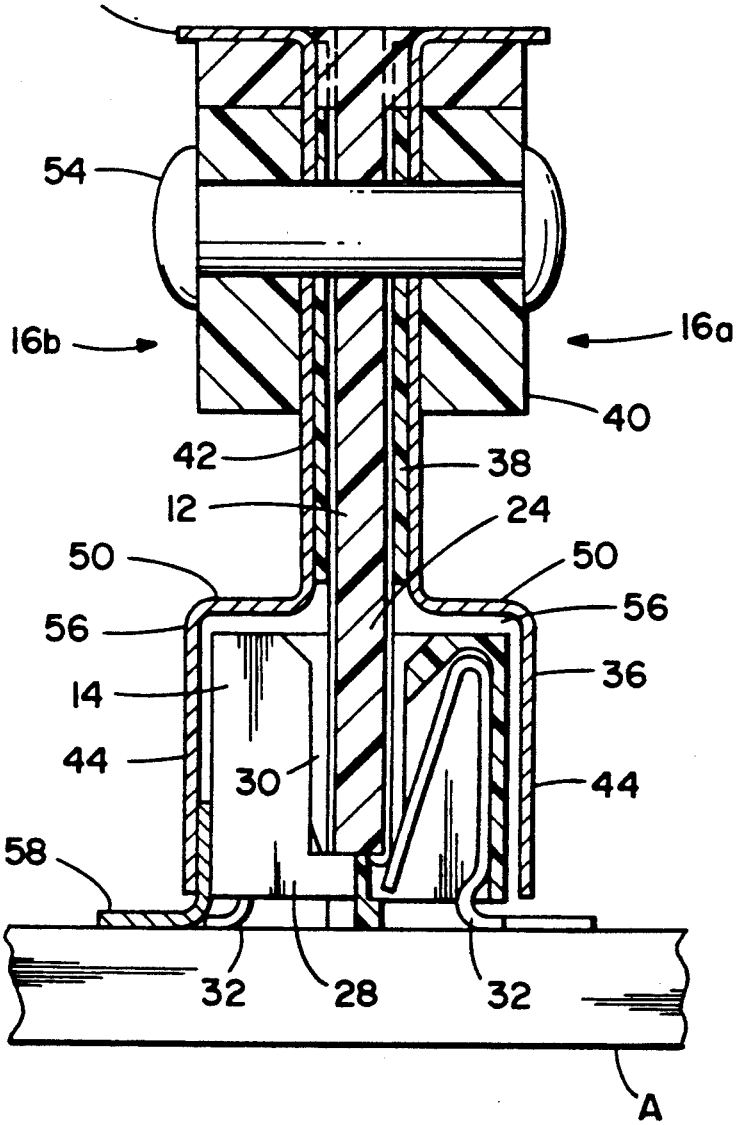
FIG. 2 is a schematic cross sectional view of the system shown in FIG. 1 shown in a connected position on a printed circuit board.

Referring also to FIG. 2, there is shown a schematic cross sectional view of the connection system 10 shown in FIG. 1 attached to a printed circuit board A. The shield 16, in the embodiment shown, generally comprises two side assemblies 16A and 16B. However, in an alternate embodiment of the present invention a single shield assembly may be provided or, more than two shield assemblies could be provided. In the embodiment shown, each shield assembly generally comprises a metal shield member 36, a dielectric spacer 38, and a backup plate 40. The metal shield members 36, in the embodiment shown, are substantially identical to each other but orientated in reverse positions relative to each other. Each shield member 36 is generally comprised of a single sheet of metal with a top section 42 and a bottom section 44. Each top section 42 generally has a planar shape with two tabs 46 and two mounting holes 48. The bottom section 44 also has a substantially planar shape, but is offset from the plane of the top section 42 by a stepped section 50. The dielectric spacers 38 are each generally comprised of a single sheet of dielectric material. The thickness of the dielectric spacers 38 are suitably selected to provide an acceptable spacing between the first connector conductors 20 and the top section 42 of the shield members 36. In a preferred embodiment of the invention, the dielectric spacers are fixedly mounted to the interior sides of the shield members 36 to thereby electrically isolate the shield members 36 from direct physical contact with the conductors 20 on the first connector 12. The backup plates 40 are generally comprised of a dielectric material and are generally provided to supply structural rigidity and retention of the shield members 36 against the first connector 12. The backup plates 40 have rivet holes 52 such that rivets 54 can be used to fixedly attach the two shield assemblies 16A and 16B to each other with a portion of the first connector 12 being sandwiched therebetween.

As seen best in FIG. 2, the shield assemblies **16*a* and 16*b* each shields substantially an entire side of the first connector 12. Because there are two shield assemblies, the shield 16 substantially surrounds the entire first connector 12. As noted above, the bottom sections 44 of the shield members 36 are offset from the top sections 42. This establishes second connector receiving areas 56 between the card edge connection area of the first connector 12 and the bottom sections 44. These areas 56 are suitably sized and shaped to be able to receive the second connector 14 therein when the two connectors 12 and 14 are connected to each other as shown in FIG. 2. As can be seen, the assemblies 16*a* and 16*b*, when the two connectors 12 and 14 are connected to each other, each also shields substantially an entire side of the second connector 14. Because there are two shield assemblies, the shield 16** substantially surrounds both of the first and second connectors.

In the embodiment shown, the second connector 14 is surface mounted on the printed circuit board A. However, the second connector 14 could be connected to any suitable type of electronic component. The board A includes ground contacts 58 adapted to make electrical contact with the shield members 36 when the first connector 12 is connected to the second connector 14. However, in an alternate embodiment, the second connector 14 might have suitable ground contacts to connect the shield members 36 to a ground in the printed circuit board A. The shield member tabs 46 are provided to electrically connect the shield members 36 to a ground of the electrical component that the tops of conductors 20 are connected to. Thus, a complete ground path is established through the shield members 36. Of course, any suitable number of ground contacts 58 or tabs 46 could be provided.

One of the advantages of the connection system described above relates to impedance. As discussed above, new connector systems are being envisioned for the future that will include very high speed transmissions being sent between electronic components such as printed circuit boards. For example, such applications might include subnanosecond risetimes. With risetimes of about 400 or 500 picoseconds impedance must be controlled through the connector, especially if the distance that the signal must travel through the connector is about ½ to 1 full inch which may be necessary for component cooling considerations. Most mismatches in impedance for short distances can be tolerated in much of current hardware. However, it is foreseeable to envision system performance requirements becoming more stringent in the future. In addition, systems are attending to be developed towards cubicity, also known as three dimensional interconnection. Therefore, connection system need to be developed in terms of total signal length in the future. This is one of the driving forces behind multichip module technology in the present. The higher the operating speeds of systems, the more critical the need for minimizing impedance mismatch throughout the system. The connection system described above is intended to meet the demands of these higher speed connection systems in the future. The effect would be to enhance system performance by controlling the impedance to a much improved degree and with lower inductance ground return paths. The thickness of the dielectric spacer 38 can be suitably selected to control the impedance of the connection system to a large degree. Because the shield 16 substantially surrounds both the first connector 12 and the second connector 14 it provides enhanced characteristics and, is relatively simple and inexpensive to manufacture and assemble.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a frame having a substantially planar section forming a card edge connection area;

signal conductors connected to the frame along the card edge connection area;

a metal shield connected to the frame, the shield having a first section located proximate the card edge connection area, but electronically isolated from the signal conductors, a second section spaced from the frame and generally parallel to the first section, and a stepped section between the first and second sections, the stepped section offsetting the second section from the first section and the frame to thereby form a second connector receiving space between the frame and the second section such that at least a portion of the card edge connection area can be positioned into a second connector with a portion of the second connector being received in the second connector receiving space.

2. A connector as in claim 1 wherein the frame includes a component connection area for connecting the frame to an electrical component.

3. A connector as in claim 1 wherein the shield includes two shield members located on opposite sides of the frame.

4. A connector as in claim 1 further comprising at least one dielectric spacer located between the shield first section and the frame substantially planar section.

5. A connector as in claim 1 wherein the shield is riveted to the frame along with at least one back-up plate to support the shield.

6. A connector as in claim 1 wherein the shield is adapted to be connected to a ground contact on a printed circuit board on which the second connector is mounted.

7. A connector as in claim 1 wherein the shield is suitably sized and shaped to substantially entirely surround the second connector.

8. An electrical connection system comprising:

a first electrical connector having a card edge connection area;

a second electrical connector having a housing with an elongate card edge receiving slot adapted to receive the card edge connection area of the first electrical connector therein; and a metal shield fixedly connected to the first connector, the shield surrounding a substantial portion of the card edge connection area of the first connector and, being adapted to substantially surround substantially the entire second connector when the two connectors are connected to each other.

9. A system as in claim 8 wherein the shield comprises at least two metal shield members, each member having a first portion and an offset second portion, the offset second portions being adapted to substantially surround the second connector.

10. A system as in claim 8 wherein the shield is adapted to be connected to a contact on a printed circuit board on which the second connector is mounted.

11. A system as in claim 8 further comprising at least one dielectrical spacer fixedly located between the shield and the first connector.

* * * * *